US010393336B2

(12) United States Patent
Choi

(10) Patent No.: US 10,393,336 B2
(45) Date of Patent: Aug. 27, 2019

(54) LIGHTING APPARATUS FOR AUTOMOBILE

(71) Applicant: HYUNDAI MOBIS Co., Ltd., Yongin-si, Gyeonggi-do (KR)

(72) Inventor: Ban Suk Choi, Yongin-si (KR)

(73) Assignee: HYUNDAI MOBIS Co., Ltd., Yongin-si (KR)

( * ) Notice: Subject to any disclaimer, the term of this patent is extended or adjusted under 35 U.S.C. 154(b) by 69 days.

(21) Appl. No.: 15/299,251

(22) Filed: Oct. 20, 2016

(65) Prior Publication Data

US 2017/0211773 A1 Jul. 27, 2017

(30) Foreign Application Priority Data

Jan. 22, 2016 (KR) ..... 10-2016-0007853

(51) Int. Cl.

| | |
|---|---|
| ***F21S 41/30*** | (2018.01) |
| ***F21S 41/141*** | (2018.01) |
| ***F21S 41/147*** | (2018.01) |
| ***F21S 41/24*** | (2018.01) |
| ***F21S 41/33*** | (2018.01) |
| ***F21S 43/14*** | (2018.01) |
| ***F21S 43/241*** | (2018.01) |
| ***F21S 43/243*** | (2018.01) |
| ***F21S 43/247*** | (2018.01) |
| ***F21S 43/31*** | (2018.01) |
| ***F21S 43/40*** | (2018.01) |

(Continued)

(52) U.S. Cl.

CPC ..... *F21S 41/19* (2018.01); *F21S 41/141* (2018.01); *F21S 41/143* (2018.01); *F21S 41/147* (2018.01); *F21S 41/24* (2018.01); *F21S 41/29* (2018.01); *F21S 41/30* (2018.01); *F21S 41/336* (2018.01); *F21S 43/14* (2018.01); *F21S 43/241* (2018.01); *F21S 43/243* (2018.01); *F21S 43/247* (2018.01); *F21S 43/31* (2018.01); *F21S 43/40* (2018.01); *F21W 2103/00* (2018.01)

(58) Field of Classification Search

CPC .... G02B 6/002; G02B 6/0063; G02B 6/0091; G02B 1/045; G02B 5/045; G02B 6/0011; G02B 6/0023; G02B 6/0045

See application file for complete search history.

(56) References Cited

U.S. PATENT DOCUMENTS 3,532,871 A * 10/1970 Shipman ..... B60Q 1/30 359/528
4,704,661 A * 11/1987 Kosmatka ..... F21S 41/336 362/518

(Continued)

FOREIGN PATENT DOCUMENTS

| | | | |
|---|---|---|---|
| JP | 2013-114913 | A | 6/2013 |
| KR | 10-2012-0062316 | A | 6/2012 |
| KR | 10-2014-0130835 | A | 11/2014 |

*Primary Examiner* — Tsion Tumebo

(74) *Attorney, Agent, or Firm* — Knobbe Martens Olson & Bear LLP

(57) ABSTRACT

Provided is a lighting apparatus for an automobile which improves luminous efficiency. To this end, the lighting apparatus for an automobile according to the embodiment of the present invention includes: a light source which produces light; a reflector which reflects the light produced by the light source; and a light guide which is illuminated with the light produced by the light source while the light passes through an interior of the light guide.

4 Claims, 2 Drawing Sheets

(51) Int. Cl.

| | |
|---|---|
| ***F21W 103/00*** | (2018.01) |
| ***F21S 41/19*** | (2018.01) |
| ***F21S 41/143*** | (2018.01) |
| ***F21S 41/29*** | (2018.01) |

(56) References Cited

U.S. PATENT DOCUMENTS 4,714,983 A * 12/1987 Lang ..... G02B 6/0021 349/65
5,921,652 A * 7/1999 Parker ..... G02B 6/0018 362/231
6,011,602 A * 1/2000 Miyashita ..... G02B 6/0038 349/61
6,259,082 B1 * 7/2001 Fujimoto ..... G02B 6/0001 250/208.1
6,827,460 B2 * 12/2004 Higuchi ..... G02B 6/0053 362/561
7,018,061 B2 * 3/2006 Chen ..... G02B 6/0016 362/619
7,419,274 B2 * 9/2008 Sawada ..... H04N 1/02815 362/23.13
7,538,340 B2 * 5/2009 Pang ..... G02B 6/0031 257/13
7,731,400 B2 * 6/2010 Dubosc ..... F21S 48/2243 362/509
7,944,428 B2 * 5/2011 Travis ..... G02B 6/002 345/102
8,087,811 B2 * 1/2012 Pakhchyan ..... G02B 6/0033 362/606
8,226,282 B2 * 7/2012 Kazaoka ..... F21V 7/005 362/519
8,434,892 B2 * 5/2013 Zwak ..... G02B 6/0018 362/235
9,086,512 B2 * 7/2015 Takase ..... G02B 6/0073
9,140,930 B2 * 9/2015 Huang ..... G02F 1/133382
9,249,945 B2 * 2/2016 Kim ..... B60Q 1/24
9,625,636 B2 * 4/2017 Durkee ..... G02B 6/0021
9,731,646 B2 * 8/2017 Shin ..... B60Q 1/34
9,766,393 B2 * 9/2017 Cabanne ..... G02B 6/0055
9,857,519 B2 * 1/2018 Shani ..... G02B 6/0015
2003/0063473 A1 * 4/2003 Aynie ..... B60Q 1/0052 362/509
2003/0169598 A1 * 9/2003 Imazeki ..... F21S 43/40 362/517
2006/0262554 A1 * 11/2006 Mok ..... G02B 6/0031 362/555
2007/0091641 A1 * 4/2007 Lin ..... G02B 6/0031 362/615
2008/0013333 A1 * 1/2008 Koizumi ..... B60Q 1/2696 362/511
2008/0186726 A1 * 8/2008 Okada ..... B60Q 1/0041 362/509
2011/0128750 A1 * 6/2011 Nakada ..... B60Q 1/2696 362/518
2011/0286202 A1 * 11/2011 Kim ..... G02B 6/0055 362/97.1
2012/0113676 A1 * 5/2012 Van Dijk ..... G02B 6/0036 362/606
2014/0043852 A1 * 2/2014 Zeng ..... F21V 7/00 362/609
2014/0268848 A1 * 9/2014 Tessnow ..... F21S 41/321 362/511
2014/0321141 A1 * 10/2014 Bauer ..... B60Q 1/085 362/511
2015/0023039 A1 * 1/2015 Seo ..... F21S 41/147 362/516
2015/0345730 A1 * 12/2015 Kim ..... B60Q 1/24 362/516
2017/0122519 A1 * 5/2017 Freiding ..... G02B 6/0036

* cited by examiner

LIGHTING APPARATUS FOR AUTOMOBILE

CROSS-REFERENCE TO RELATED APPLICATIONS

The present application claims priority to Korean Patent Application Number 10-2016-0007853 filed Jan. 22, 2016, the entire contents of which the application is incorporated herein for all purposes by this reference.

TECHNICAL FIELD

The present disclosure relates to a lighting apparatus for an automobile.

BACKGROUND

In general, various lighting apparatuses, such as headlamps installed at a front side of an automobile, rear combination lamps installed at a rear side of the automobile, and fog lamps to be turned on in a foggy day, are installed in the automobile.

Recently, an indirect illumination type lighting apparatus has been developed, which has a light source that produces light and is not directly visible from the outside of the automobile.

SUMMARY

One aspect of the present invention has been made in an effort to provide a lighting apparatus for an automobile which improves luminous efficiency.

Another aspect provides a lighting apparatus for an automobile, which has a reflector which reflects light produced by a light source, and a light guide which is illuminated while the light produced by the light source passes through an interior of the light guide.

Technical problems of the present invention are not limited to the aforementioned technical problem, and other technical problems, which are not mentioned above, may be clearly understood by those skilled in the art from the following descriptions.

An embodiment of the present invention provides a lighting apparatus for an automobile, including: a light source which produces light; a reflector which reflects the light produced by the light source; and a light guide which is illuminated while the light produced by the light source passes through an interior of the light guide.

Another embodiment of the present invention provides a lighting apparatus for an automobile, including: a light source which produces light and emits the light within an effective angle; a reflector which reflects the light in a partial region within the effective angle; and a light guide which is illuminated with the light in the remaining region within the effective angle while the light passes through an interior of the light guide.

Other detailed matters of the embodiment are included in the detailed description and the drawings.

According to the lighting apparatus for an automobile according to the embodiment of the present invention, the reflector reflects light produced by a single light source, and the light guide is illuminated with the light, thereby improving luminous efficiency.

A design is also improved because of a lighting image of the light guide.

A structure is simple, and thus costs are reduced.

The effects of the present invention are not limited to the aforementioned effects, and other effects, which are not mentioned above, will be clearly understood by those skilled in the art from the claims.

DETAILED DESCRIPTION

Figure 1:
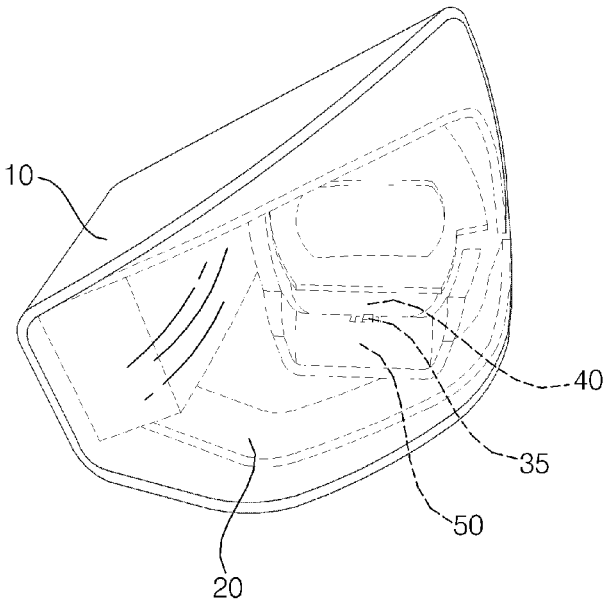
FIG. 1 is a perspective view illustrating a lighting apparatus for an automobile according to an embodiment of the present invention.

Advantages and features of the present invention and methods of achieving the advantages and features will be clear with reference to embodiments described in detail below together with the accompanying drawings. However, the present invention is not limited to the embodiments set forth below, and may be embodied in various other forms. The present embodiments are for rendering the disclosure of the present invention complete and are set forth to provide a complete understanding of the scope of the invention to a person with ordinary skill in the technical field to which the present invention pertains, and the present invention will only be defined by the scope of the claims. Like reference numerals indicate like elements throughout the specification.

An indirect illumination type lighting apparatus is classified into a lighting apparatus which uses a reflector for reflecting light produced by a light source to a lens, and a lighting apparatus which uses a light guide which is illuminated while light produced by a light source passes through an interior of the light guide and is totally reflected to the outside.

The light produced by the light source is totally reflected and emitted to the outside while being guided by patterns formed in the light guide in a proceeding direction.

According to an example of the lighting apparatus for an automobile, because a light source for emitting light to the reflector and a light source for emitting light to the light guide are separately provided, luminous efficiency is not high, and a structure is complicated.

Hereinafter, a lighting apparatus for an automobile according to an embodiment of the present invention will be described with reference to the drawings.

Figure 2:
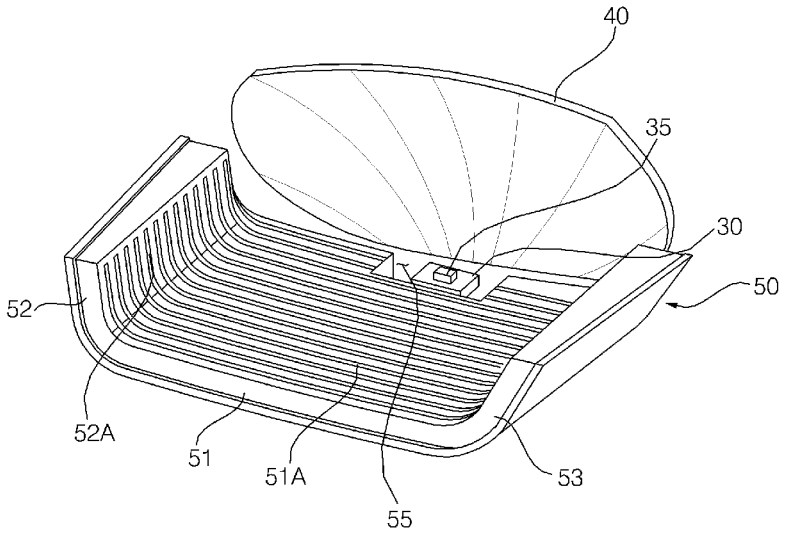
FIG. 2 is a perspective view illustrating an internal configuration of the lighting apparatus for an automobile which is illustrated in FIG. 1.
Figure 3:
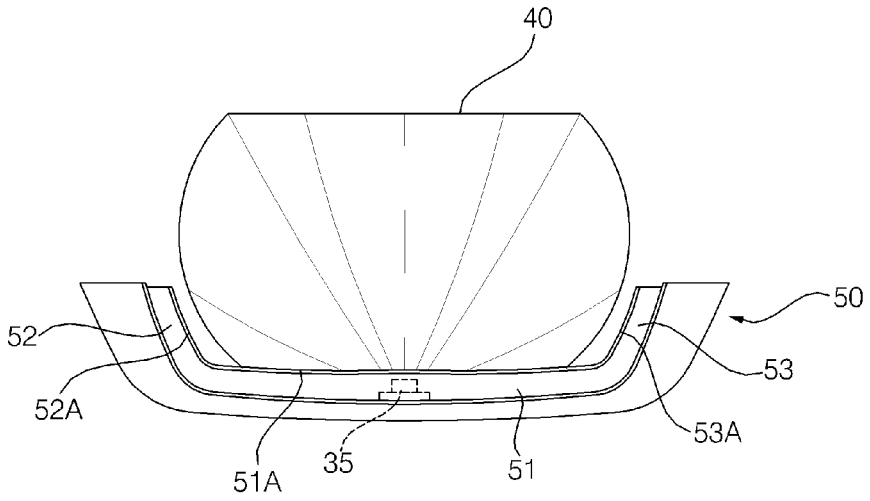
FIG. 3 is a front view of FIG. 2.
Figure 4:
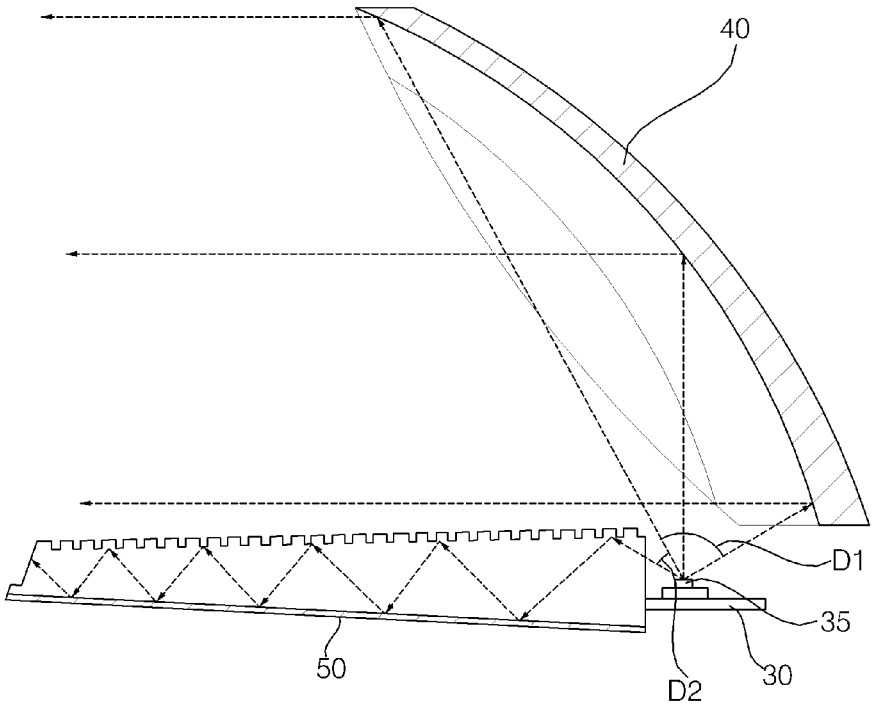
FIG. 4 is a cross-sectional side view of FIG. 2.

FIG. 1 is a perspective view illustrating a lighting apparatus for an automobile according to an embodiment of the present invention, FIG. 2 is a perspective view illustrating an internal configuration of the lighting apparatus for an automobile which is illustrated in FIG. 1, FIG. 3 is a front view of FIG. 2, and FIG. 4 is a cross-sectional side view of FIG. 2.

Referring to FIGS. 1 to 4, a lighting apparatus for an automobile according to an embodiment of the present invention is a headlamp installed at a front side of an automobile, and serves as a high beam which illuminates a location disposed at a distance from a front side of the automobile, a daytime running light (DRL) which always remains turned on during the day time, and a position lamp which always remains turned on at night so as to inform drivers in peripheral vehicles of the position of the automobile. However, the lighting apparatus for an automobile according to the embodiment of the present invention is not limited to the headlamp, and may be used as a rear combination lamp installed at a rear side of the automobile.

The lighting apparatus for an automobile according to the embodiment of the present invention includes a housing 10, a lens 20, a circuit board 30, a reflector 40, and a light guide 50.

The housing 10 has therein a vacant space, and is opened at a front side thereof. The circuit board 30, the reflector 40, and the light guide 50 are accommodated in the vacant space in the housing 10.

A light source 35, which produces light, is mounted on the circuit board 30. The light source 35 is formed of a light emitting diode (LED). The circuit board 30 is formed as a printed circuit board (PCB) on which a circuit for supplying electricity to the light source 35 is printed. The light source 35 is mounted on an upper surface of the circuit board 30. The light source 35 is disposed below the reflector 40 and disposed rearward of the light guide 50.

The light source 35 is invisible from the outside of the automobile, and only the light reflected by the reflector 40 and only the light illuminating the light guide 50 are visible from the outside of the automobile. In embodiments, the lighting apparatus for an automobile according to the embodiment of the present invention is an indirect illumination type lighting apparatus, in which the light produced by the light source 35 is not distributed directly to the outside through the lens 20, but only the light reflected by the reflector 40 and only the light illuminating the light guide 50 are distributed to the outside through the lens 20.

The reflector 40 is disposed above the light source 35 and reflects the light produced by the light source 35 forward. A front surface of the reflector 40 is concavely formed rearward, and an aluminum material, which may reflect light, is deposited on the concavely formed front surface, such that the front surface of the reflector 40 becomes a reflective surface that reflects the light produced by the light source 35 forward. The reflector 40 is configured as a multi-facet reflector (MFR) having a plurality of reflective surfaces formed on the front surface of the reflector. The plurality of reflective surfaces may reflect and diffuse the light produced by the light source 35 in different directions.

The light guide 50 is illuminated while the light produced by the light source 35 passes through an interior of the light guide 50. The light guide 50 is disposed forward of the light source 35 and below the reflector 40. The light guide 50 guides the light produced by the light source 35 forward from a rear end. A front end of the light guide 50 is disposed to further protrude forward than a front end of the reflector 40.

The light guide 50 has a silicone base, and a pattern film, which has patterns formed to guide the light produced by the light source 35 forward from the rear end, is formed integrally with one surface of the silicone. The light produced by the light source 35 enters the rear end of the light guide 50 and is totally reflected to the outside while moving forward by the patterns, such that the light guide 50 is illuminated with the light.

If the lighting apparatus for an automobile according to the embodiment of the present invention is installed at the rear side of the automobile, the reflector 40 may be disposed so that the concave reflective surface is directed rearward, and reflect the light produced by the light source 35 rearward, and the light guide 50 may be disposed rearward of the light source 35 and below the reflector 40 such that the light guide 50 may be illuminated with the light produced by the light source 35 while guiding the light rearward from the front end.

The lens 20 is coupled to the opened front side of the housing 10 while shielding the opened front side of the housing 10. The lens 20 distributes the light reflected forward by the reflector 40 and the light illuminating the light guide 50 to the outside of the automobile. The lens 20 is made of a colorless transparent material. However, the lens 20 may be made of a red or orange opaque material in accordance with a position of the automobile where the lighting apparatus for an automobile according to the embodiment of the present invention is installed.

The light source 35 produces and radiates light within effective angles D1 and D2. The effective angles D1 and D2 of the light source 35 are 120 degrees.

The reflector 40 reflects rear light of the light produced by the light source 35, which is light in a partial region D1 within the effective angles D1 and D2, toward the lens 20 disposed forward of the reflector 40, and the light guide 50 is illuminated with front light of the light produced by the light source 35, which is light in the remaining region D2 within the effective angles D1 and D2, while the light passes through the interior of the light guide 50.

The light in the remaining region D2 within the effective angles D1 and D2, which is light of the light produced by the light source 35 which illuminates the light guide 50, is light that is not emitted to the reflector 40. If the lighting apparatus for an automobile according to the embodiment of the present invention does not include the light guide 50, the light of the light produced by the light source 35, which is in the remaining region D2 within the effective angles D1 and D2, becomes ineffective light because this light is not emitted to the reflector 40. The lighting apparatus for an automobile according to the embodiment of the present invention includes the reflector 40 which reflects light emitted from the light source 35, and the light guide 50 which is illuminated with light of the light produced by the light source 35 which is not emitted to the reflector 40, thereby improving luminous efficiency compared to a lighting apparatus including only the reflector 40.

In a case in which the light guide 50 is disposed forward of the light source 35, the light guide 50 is illuminated with the light in the front region within the effective angles D1 and D2 while the light passes through the interior of the light guide 50. In a case in which the light guide 50 is disposed forward of the light source 35, the reflector 40 reflects the light, which is in the rear region within the effective angles D1 and D2, forward.

If the lighting apparatus for an automobile according to the embodiment of the present invention is installed at the rear side of the automobile, the light guide 50 is disposed rearward of the light source 35. In this case, the light guide 50 is illuminated with the light in the rear region within the effective angles D1 and D2 while the light passes through the interior of the light guide 50. In a case in which the light guide 50 is disposed rearward of the light source 35, the reflector 40 reflects the light, which is in the front region within the effective angles D1 and D2, rearward.

The light guide 50 is formed in an approximately U shape when viewed in a front and rear direction, thereby providing a three-dimensional lighting image. In embodiments, the light guide 50 includes a central portion 51, a first side portion 52, and a second side portion 53.

The light source 35 is disposed rearward of the central portion 51. The light produced by the light source 35 enters the rear end of the central portion 51 and then moves forward. The first side portion 52 is formed to be bent upward at a left side of the central portion 51 which is one side in a proceeding direction of light, and the second side portion 53 is formed to be bent upward at a right side of the central portion 51 which is the other side in the proceeding direction of light.

A light source insertion groove 55 into which the light source 35 is inserted is formed at a rear end of the central portion 51 which is one end in the proceeding direction of light. The light source insertion groove 55 is formed in a quadrangular shape at a center in a left and right direction of the central portion 51. In a state in which the light source 35 is inserted into the light source insertion groove 55, an upper surface of the light source 35 is disposed below an upper surface of the central portion 51, such that the light source 35 is invisible from the outside of the automobile.

When viewing the upper side of the light guide 50, the effective angles D1 and D2 of the light produced by the light source 35 mean an angle between a straight line, which runs from a center of the light source 35 to an upper end of the first side portion 52, and a straight line which runs the center of the light source 35 to the upper end of the second side portion 53.

When viewing the front side of the light guide 50, the upper surface of the central portion 51 coincides with a lower end of the reflector 40. That is, the upper surface of the central portion 51 and the lower end of the reflector 40 are disposed on a straight line.

When viewing the front side of the light guide 50, the reflector 40 is disposed between the first side portion 52 and the second side portion 53. That is, a left end of the reflector 40 is disposed at a right side of the first side portion 52, and a right end of the reflector 40 is disposed at a left side of the second side portion 53.

The central portion 51 is formed of a flat quadrangular plate, and disposed in parallel with the upper surface of the light source 35. An angle between the first side portion 52 and the central portion 51 or between the second side portion 53 and the central portion 51 is 90 degrees or more.

A plurality of optic protrusions 51A, 52A, and 53A, which diffuses light passing through the interior of the light guide 50, is formed on the upper surface of the light guide 50. The optic protrusions 51A, 52A, and 53A include a first protrusion 51A disposed on the central portion 51, a second protrusion 52A disposed on the first side portion 52, and a third protrusion 53A disposed on the second side portion 53. The number of first protrusions 51A is two or more, the number of second protrusions 52A is two or more, and the number of third protrusions 53A is two or more.

As described above, according to the lighting apparatus for an automobile according to the embodiment of the present invention, the reflector 40 reflects the light produced by the single light source 35, and the light guide 50 is illuminated with the light, thereby improving luminous efficiency, improving a design because of a lighting image of the light guide 50, and reducing costs because of a simple structure.

It may be understood by a person skilled in the art that the present invention may be carried out in other specific forms without changing the technical spirit or the essential characteristics of the present invention. Thus, it should be appreciated that the embodiments described above are intended to be illustrative in every sense, and not restrictive. The scope of the present invention is represented by the claims to be described below rather than the detailed description, and it should be interpreted that all the changes or modified forms, which are derived from the meaning and the scope of the claims, and the equivalents thereto, are included in the scope of the present invention.

What is claimed is:

1. A lighting apparatus for an automobile, comprising:

a light source configured to emit light beams upwardly;

a reflector located above the light source and configured to reflect light beams from the light source forwardly; and a light guide configured to guide light beams from the light source forwardly, wherein the light guide comprises a grooved top surface configured to diffuse light beams in the light guide and a bottom surface inclined with respect to the grooved top surface such that the light guide is tapered along a forward direction, wherein the light guide further comprises a light receiving surface placed in front of the light source such that the light source is blocked by the light guide when viewed in a backward direction from the front of the light guide, wherein the light source is arranged such that a light beam from the light source emitted in a first emitting angle proceeds toward the reflector and further such that a light beam from the light source emitted in a second emitting angle is incident to the light guide, wherein the light guide is spaced from the reflector with a space therebetween such that the light beam emitted in the first emitting angle proceeds to the reflector through the space, is reflected by the reflector, and then proceeds forwardly without passing through the light guide while the light beam emitted in the second emitting angle proceeds through the light guide.

2. The lighting apparatus of claim 1, wherein the light guide includes:

a central portion;

a first side portion which is formed to be bent upward at one side of the central portion in a proceeding direction of light; and a second side portion which is formed to be bent upward at the other side of the central portion in the proceeding direction of light.

3. The lighting apparatus of claim 2, wherein the light guide comprises a recess at the central portion for receiving the light source.

4. The lighting apparatus of claim 2, wherein an angle between the first side portion and the central portion or between the second side portion and the central portion is 90 degrees or more.

* * * * *